US005178696A

United States Patent [19]

Ikeda et al.

[11] Patent Number: 5,178,696

[45] Date of Patent: Jan. 12, 1993

[54] GAS GENERATING COMPOSITION FOR AUTOMOBILE AIR BAG

[75] Inventors: Yoshiyuki Ikeda, Ube; Kenjiro Ikeda, Kitakyushu; Masaharu Murakami, Yamaguchi; Atusy Iwamoto, Onoda, all of Japan

[73] Assignee: Nippon Kayaku Kabushiki Kaisha, Tokyo, Japan

[21] Appl. No.: 749,303

[22] Filed: Aug. 23, 1991

[30] Foreign Application Priority Data

Sep. 3, 1990 [JP] Japan ..... 2-230494

[51] Int. Cl.[5] ..... C06B 45/10

[52] U.S. Cl. ..... 149/18; 149/19.7; 149/19.91; 149/35

[58] Field of Search ..... 149/35, 19.7, 19.91, 149/18

[56] References Cited

U.S. PATENT DOCUMENTS

| | | | |
|---|---|---|---|
| 3,755,182 | 8/1973 | Marshal | 252/188.3 |
| 3,883,373 | 5/1975 | Sidebottom | 149/6 |
| 3,920,575 | 11/1975 | Shiki et al. | 252/188.3 |
| 3,931,040 | 1/1976 | Breazeale | 252/188.3 |
| 3,947,300 | 3/1976 | Passauer et al. | 149/35 |
| 4,214,938 | 7/1980 | Hamilton et al. | 149/35 |
| 4,376,002 | 3/1983 | Utracki | 149/35 |
| 4,533,416 | 8/1985 | Poole | 149/35 |
| 4,734,141 | 3/1988 | Cartwright et al. | 149/35 |
| 4,920,743 | 5/1990 | Cartwright | 149/35 |
| 4,931,111 | 6/1990 | Poole et al. | 149/35 |
| 4,981,536 | 1/1991 | Bender | 149/35 |

*Primary Examiner*—Edward A. Miller
*Attorney, Agent, or Firm*—Nields & Lemack

[57] ABSTRACT

Disclosed in this invention is a gas generating composition for air bags for automobiles, comprising sodium azide, aluminum sulfate, one of silicon dioxide, alumina and aluminum silicate, and preferably a lubricant and/or a binder. This composition has the advantages such as adequate speed of gas generation and small amount of heat and harmful substances produced when the gas is generated from the composition.

6 Claims, No Drawings

GAS GENERATING COMPOSITION FOR AUTOMOBILE AIR BAG

This invention relates to a gas generating composition for automobile air bag, more specifically a composition capable of generating a gas for inflating the air bag adapted to an automobile for protecting the driver and the passenger(s) in the event of a crash.

The air bags designed to be furnished in an automobile and inflated in the event of a crack-up for protecting the driver and the passenger(s) are well known. These air bags are usually of a mechanism in which upon crash or collision of an automobile against other vehicle or object, the impact is sensed by an appropriate electric or mechanical sensor to actuate an ignitor comprising ignition, secondary ignition and/or other means to burn a gas generating composition to thereby quickly generate a large amount of gas, and this gas is led into the bags to let them form air cushions which hold the bodies of the driver and the passenger(s) to protect them from the impact of crash.

Evidently, the gas generating composition is demanded to meet the following requirements.

(a) Generation of a gas must be completed within the period of 30 to 60 milliseconds as said mechanism needs to be operated instantaneously upon occurrence of a crash.

(b) The generated gas must be innoxious and non-corrosive as it is released in the vehicle after it has been used for inflating the bags to form air cushions for holding the bodies of the driver and the passenger(s).

(c) The composition should not generate so much heat that causes damage to the air bags or a burn to the driver and the passenger(s).

The conventional gas generating compositions for air bags, as for instance disclosed in U.S. Pat. Nos. 3,947,300, 3,920,575 and 3,983,373, are principally made up of an alkaline metal azide, an oxidizer or a metal oxide, and a material which reacts with and adsorbs the alkaline metal or oxides thereof produced as a by-product from the reaction of said compositions. These gas generating compositions are high in calorific value because of use of an oxidizer or a metal oxide as an accelerator of the reaction for generating nitrogen gas. Therefore, the alkaline metal or oxides thereof and the material which ha captured them take time for being solidified by cooling and tend to pass uncaught through the filter, with the result that the harmful alkaline substances are released in the vehicle in the form of dust or fumes.

U.S. Pat. No. 3,755,182 discloses a gas generating composition comprising sodium azide and a metal sulfate. This composition is low in calorific value and generates a gas of a relatively low temperature, but the actual examples thereof containing calcium sulfate shown in the Examples are unapplicable to air bags for automobiles because of too low rate of burning.

It is desired that dust or fumes of the corrosive and harmful alkaline metal oxides or hydroxides in the gas released in the vehicle be minimized in quantity.

As a result of assiduous studies on the subject matter, the present inventors found that the combined use of sodium azide, aluminum sulfate and silicon dioxide, alumina or aluminum silicate can provide a gas generating composition for automobile air bags which has appropriate burning rate and is low in calorific value and minimized in the amount of fumes generated, realizing a marked reduction of the amount of the alkaline metal or its oxides or hydroxides produced as by-products in burning of the composition.

Thus, according to the present invention, there is provided a gas generating composition for air bags in automobiles, comprising sodium azide, aluminum sulfate and one member selected from the group consisting of silicon dioxide, alumina and aluminum silicate. Preferably the composition further contains at least one member selected from the group consisting of lubricant and binder.

The present invention will be described in detail hereinbelow.

In the present invention, sodium azide is used in an amount within the range of preferably 50% to 80% by weight, more preferably 60% to 75% by weight, based on the total amount of the gas generating composition.

Aluminum sulfate used in the present invention is preferably an anhydrous salt, and it is used in an amount within the range of preferably 10% to 40% by weight, more preferably 15% to 25% by weight, based on the total amount of the composition.

Silicon dioxide, alumina or aluminum silicate, which constitutes another essential component of the composition of this invention, is used in an amount within the range of preferably 5%to 40% by weight, more preferably 7% to 25% by weight, based on the total amount of the composition. Said materials may be used either singly or in combination.

The gas generating composition of this invention can be produced by the same methods as used for producing the conventional gas generating compositions for air bags. For instance, the composition of this invention is produced in the form of tablets by uniformly mixing the component materials by an ordinary mixing device such as ball mill or V type mixer and molding the mixture into tablets, measuring 3-15 mm in diameter and 1-10 mm in thickness, by a single-shot or rotary tableting machine.

In the production of the composition of this invention, if a mixture of said component materials, viz. sodium azide, aluminum sulfate and silicon dioxide, alumina or aluminum silicate, is tableted directly, there may take place capping, or even laminating in certain cases, of the tablets. So, it is suggested to add a lubricant such as talc, calcium stearate, magnesium stearate or the like to the mixture. Addition of such a lubricant to the mixture enables long-time continuous formation of the tablets with a sheen and uniform hardness.

Addition of a binder such as cellulose, polyvinyl pyrrolidone, calcium hydrogenphosphate or the like is also recommendable as it conduces to further enhancement of hardness of the tablets.

The lubricant may be used in an amount not exceeding 5% by weight, preferably in the range of 0.1% to 2% by weight, based on the total amount of the gas generating composition.

The binder may be used as desired in an amount not greater than 15% by weight, preferably in the range of 3% to 10% by weight, based on the total amount of the composition.

The present invention will hereinafter be described in further detail with reference to the examples thereof.

EXAMPLE 1

70 parts by weight of sodium azide, 22 parts by weight of aluminum sulfate and 8 parts by weight of silicon dioxide were mixed in a ball mill at a speed of 60 r.p.m. for 20 minutes, and the resulting mixture was molded into tablets, 5 mm in diameter and 3 mm thick, by a single-shot tableting machine (Model 6B-2 mfd. by Kikusui Seisakusho K.K.).

After drying at 105° C. for 2 hours, 25 g of the tablets were taken out and burned through electrical ignition of a boron-potassium nitrate priming powder is a hermetically sealed 1,000 cc stainless steel vessel having a pressure sensor fitted thereto, and the time required till reaching the highest peak pressure of the generated gas was measured.

Thereafter, the gas was taken out of the vessel through a filter and led into a 10 cm-diameter, 1 m long iron tube fitted with transparent glass at both ends, and after placing the inside of said iron tube under atmospheric pressure, illuminance of the transmitted light of a 100 W halogen lamp (6,300 lm) inserted into said iron tube from one end thereof was measured by a digital illuminometer (Model ANA-999 mfd. by Inouchi Corp.) and the measured illuminance was represented as a relative value of the amount of fumes. The illuminance before admitting the gas into the iron tube was 6,250 luces. The produced gas was subjected to an organoleptic test by odor of the gas, and the amount of alkaline substances such as sodium oxide contained in the gas was measured as sodium hydroxide. Also, the produced amounts of the harmful substances such as nitrogen oxides, sulfur oxides, carbon monoxide, cyanides, hydrogen sulfide, etc., were examined by an ordinary chemical determination method. Concerning sulfur oxides, cyanides and hydrogen sulfide, no traces of these substances were detected. The amount of heat generated by the composition wa measured by a differential scanning calorimeter (Model DT-40 mfd. by Shimadzu Corp.).

Regarding the tablets, determinations were made on easiness of tablet molding, luster of tablets after formation of 1,000 tablets and compressive break strength of 20 tablets by a Monsanto hardness tester.

EXAMPLE 2

70 parts by weight of sodium azide, 18 parts by weight of aluminum sulfate, 12 parts by weight of alumina, 0.5 part by weight of magnesium stearate and 3 parts by weight of calcium hydro9enphosphate were mixed and molded into tablets in the same ways as in Example 1.

Also, the amount of fumes, amounts of produced harmful substances, calorific value, tablet moldability and tablet properties were examined by the same methods as used in Example 1.

EXAMPLE 3

70 parts by weight of sodium azide, 20 parts by weight of aluminum sulfate, 10 parts by weight of aluminum silicate and 3 parts by weight of calcium hydrogen-phosphate were mixed and tableted in the same ways as in Example 1.

Also, the amount of fumes, amounts of generated harmful substances, calorific value, tablet moldability and tablet properties were examined by the same methods as used in Example 1.

EXAMPLE 4

70 parts by weight of sodium azide, 22 parts by weight of aluminum sulfate, 8 parts by weight of silicon dioxide and 0.5 part by weight of magnesium stearate were mixed and tableted in the same ways as in Example 1.

Also, the amount of fumes, amounts of produced harmful substances, calorific value, tablet moldability and tablet properties were examined by the same methods as used in Example 1.

EXAMPLE 5

67 parts by weight of sodium azide, 25 parts by weight of aluminum sulfate and 8 parts by weight of silicon dioxide were mixed and tableted in the same ways as in Example 1.

Also, the amount of fumes, amounts of produced harmful substances, calorific value, tablet moldability and tablet properties were examined by the same method as used in Example 1.

EXAMPLE 6

77 parts by weight of sodium azide, 15 parts by weight of aluminum sulfate and 8 parts by weight of silicon dioxide were mixed and tablets in the same ways as in Example 1.

Also, the amount of fumes, amounts of produced harmful substances, calorific value, tablet moldability and tablet properties were examined by the same method as used in Example 1.

COMPARATIVE EXAMPLE 1

70 parts by weight of aluminum azide, 30 parts by weight of aluminum sulfate and 0.5 part by weight of magnesium stearate were mixed and tableted in the same ways as in Example 1.

Also, the amount of fumes, amounts of produced harmful substances, calorific value, tablet moldability and tablet properties were examined by the same methods as used in Example 1.

COMPARATIVE EXAMPLE 2

70 parts by weight of sodium azide, 20 parts by weight of magnesium sulfate, 10 parts by weight of aluminum silicate and 3 parts by weight of calcium hydrogenphosphate were mixed and tableted in the same ways as in Example 1.

Also, the amount of fumes, amounts of produced harmful substances, calorific value, tablet moldability and tablet properties were examined by the same methods as used in Example 1.

COMPARATIVE EXAMPLE 3

70 parts by weight of sodium azide, 22 parts by weight of calcium sulfate and 8 parts by weight of silicon dioxide were mixed and tableted in the same ways as in Example 1.

Also, the amount of fumes, amounts of produced harmful substances, calorific value, tablet moldability and tablet properties were examined by the same methods as used in Example 1.

COMPARATIVE EXAMPLE 4

57 parts by weight of sodium azide, 17 parts by weight of potassium nitrate and 26 parts by weight of silicon dioxide were mixed and tableted in the same ways as in Example 1.

Also, the amount of fumes, amounts of produced harmful substances, calorific value, tablet moldability and tablet properties were examined by the same methods as used in Example 1.

COMPARATIVE EXAMPLE 5

57 parts by weight of sodium azide, 17 parts by weight of potassium nitrate, 26 parts by weight of alumina, 0.5 part by weight of magnesium stearate and 3 parts by weight of calcium hydrogenphosphate were mixed and tableted in the same ways as in Example 1.

Also, the amount of fumes, amounts of produced harmful substances, calorific value, tablet moldability and tablet properties were examined by the same ways as in Example 1.

COMPARATIVE EXAMPLE 6

80 parts by weight of sodium azide, 10 parts by weight of aluminum sulfate and 10 parts by weight of potassium nitrate were mixed and tableted in the same ways as in Example 1.

Also, the amount of fumes, amounts of produced harmful substances, calorific value, tablet moldability and tablet properties were examined by the same methods as used in Example 1.

The compositions of Examples 1-6 and Comparative Examples 1-6 are shown collectively in Tables 1 and 2. The figures given in the tables are parts by weight.

The results of determinations of calorific value, illuminance (relative value of amount of fumes), amounts of harmful substances produced, burning characteristics, tablet moldability and tablet properties in Examples 1-6 and Comparative Examples 1-6 are shown collectively in Tables 3 and 4.

TABLE 1

| | Examples | | | | | |
|---|---|---|---|---|---|---|
| | 1 | 2 | 3 | 4 | 5 | 6 |
| Sodium azide | 70 | 70 | 70 | 70 | 67 | 77 |
| Aluminum sulfate | 22 | 18 | 20 | 22 | 25 | 15 |
| Silicon dioxide | 8 | | | 8 | 8 | 8 |
| Alumina | | 12 | | | | |
| Aluminum silicate | | | 10 | | | |
| Magnesium stearate | | 0.5 | | 0.5 | | |
| Calcium hydrogen-phosphate | | 3 | 3 | | | |

TABLE 2

| | Comparative Examples | | | | | |
|---|---|---|---|---|---|---|
| | 1 | 2 | 3 | 4 | 5 | 6 |
| Sodium azide | 70 | 70 | 70 | 57 | 57 | 80 |
| Aluminum sulfate | 30 | | | | | 5 |
| Magnesium sulfate | | 20 | | | | |
| Calcium sulfate | | | 22 | | | |
| Potassium nitrate | | | | 17 | 17 | 15 |
| Silicon dioxide | | | 8 | 26 | | |
| Alumina | | | | | 26 | |
| Aluminum silicate | | 10 | | | | |
| Magnesium stearate | 0.5 | | | | 0.5 | |
| Calcium hydrogen-phosphate | | 3 | | | 3 | |

TABLE 3

| | | Examples | | | | | |
|---|---|---|---|---|---|---|---|
| | | 1 | 2 | 3 | 4 | 5 | 6 |
| Calorific value (Cal/g) | | 406 | 390 | 395 | 422 | 375 | 450 |
| Illuminance (1x) | | 5320 | 5500 | 5940 | 5300 | 5640 | 4620 |
| Odor | | None | None | None | None | None | None |
| Amount of alkalis calculated as NaOH (mg) | | 33 | 28 | 24 | 30 | 20 | 45 |
| Nitrogen oxides (ppm) | | <1 | 2 | 5 | 3 | <1 | 3 |
| Burning characteristics | Maximum peak time (ms) | 38 | 36 | 40 | 40 | 48 | 43 |
| | Maximum peak pressure (atm) | 72 | 71 | 72 | 72 | 65 | 73 |
| Tablet moldability | | Capping occurred | Good | Good | Good | Capping occurred | Capping occurred |
| Surface luster | | Had luster at peripheral part | Had luster | No luster at central part | Had luster | No luster | Had luster at peripheral part |
| Tablet strength (kg) n = 20 | Average | 14.2 | 25.8 | 24.8 | 20.1 | 12.5 | 14.9 |
| | Range | 10~22 | 20~29 | 18~28 | 18~23 | 6~15 | 8~17 |

TABLE 4

| | | Comparative Examples | | | | | |
|---|---|---|---|---|---|---|---|
| | | 1 | 2 | 3 | 4 | 5 | 6 |
| Calorific value (Cal/g) | | 415 | 430 | 380 | 745 | 755 | 851 |
| Illuminance (1x) | | 2020 | 5720 | 5500 | 1850 | 2240 | 2980 |
| Odor | | Slight irritant odor | None | None | Strong irritant odor | Strong irritant odor | Strong irritant odor |
| Amount of alkalis calculated as NaOH (mg) | | 80 | 60 | 39 | 170 | 190 | 245 |
| Nitrogen oxides (ppm) | | <1 | 3 | 6 | 40 | 45 | 30 |
| Burning characteristics | Maximum peak time (ms) | 38 | 105 | 125 | 35 | 38 | 32 |
| | Maximum peak | 73 | 58 | 52 | 74 | 72 | 75 |

TABLE 4-continued

| | | Comparative Examples | | | | | |
|---|---|---|---|---|---|---|---|
| | | 1 | 2 | 3 | 4 | 5 | 6 |
| | pressure (atm) | | | | | | |
| Tablet moldability | | Good | Good | Capping occurred | Capping occurred | Good | Capping occurred |
| Surface luster | | Had luster | Good luster | No luster | No luster | Had luster | No luster at peripheral part |
| Tablet strength (kg) n = 20 | Average | 18.5 | 27.5 | 13.7 | 11.5 | 24.4 | 11.9 |
| | Range | 16~24 | 22~30 | 6~18 | 5~17 | 18~28 | 5~15 |

The following facts are noted from Tables 3 and 4.

When a sulfate is used as combustion accelerator, the calorific value and alkali effusion rate are low. The burning characteristics and alkali effusion quantities are varied as the ratios of sodium azide and aluminum sulfate are changed as noted from Examples 1, 5 and 6. In case silicon dioxide, alumina, etc. is added, the amount of white smoke is notably reduced as noted from Example 1 and Comparative Example 1. When the sulfates other than aluminum sulfate are used, the obtained compositions are unusable for air bags in automobiles because of low burning rate as noted from Comparative Examples 2 and 3.

As for the gas generating compositions using potassium nitrate as in Comparative Examples 4 and 5, when the produced gas is passed through a filter, the residue is not sufficiently solidified, because of high calorific value, even when using silicon dioxide, alumina or the like as alkali adsorbent, and a large volume of white smoke is produced. In this case, therefore, the alkali effusion quantities are high and also nitrogen oxides are formed in large quantities.

In the case of the compositions containing no silicon dioxide, alumina, etc. the residue is scarcely solidified and the alkali effusion quantities are very high as noted from Comparative Example 6.

Addition of a lubricant allows, in the case of certain compositions, molding of the lusterous tablets with relatively uniform hardness.

Addition of a binder enhances the strength of the molded tablets.

As described above, there is provided according to the present invention a gas generating composition which is minimized in generation of heat and in formation of harmful substances and also prominently small in amount of fumes produced when the composition is burned for generating a gas. Especially when a lubricant and/or a binder are blended, there can be obtained a gas generating composition which can be molded into and provided as tablets having luster, uniform thickness and high strength.

What is claimed is:

1. A gas generating composition for automobile air bags, consisting essentially of sodium azide, aluminum sulfate and one member selected from the group consisting of silicon dioxide, alumina and aluminum silicate.

2. A gas generating composition according to claim 1, consisting essentially of 50–80% sodium azide, 10–40% by weight of aluminum sulfate, and 5–40% by weight of silicon dioxide, alumina or aluminum silicate based on the total weight of the gas generating composition.

3. A gas generating composition according to claim 1, further consisting essentially of at least one member selected from the group consisting of a lubricant and a binder.

4. A gas generating composition according to claim 3, wherein the lubricant is present in an amount of 5% by weight or less and the binder is present in an amount of 15% by weight of less based on the total weight of the gas generating composition.

5. A gas generating composition according to claim 3, wherein the lubricant is one member selected from the group consisting of talc, calcium stearate and magnesium stearate, and the binder is one member selected from the group consisting of cellulose, polyvinyl pyrrolidone and calcium hydrogenphosphate.

6. A gas generating composition according to claim 4, wherein the lubricant is one member selected from the group consisting of talc, calcium stearate and magnesium stearate, and the binder is one member selected from the group consisting of cellulose, polyvinyl pyrrolidone and calcium hydrogenphosphate.

* * * * *